US010426981B2

(12) United States Patent
Werz et al.

(10) Patent No.: US 10,426,981 B2
(45) Date of Patent: Oct. 1, 2019

(54) DEPLOYMENT UNIT FOR AN AVALANCHE RESCUE SYSTEM, USE OF AN ACTUATING HANDLE, AND DEPLOYMENT DEVICE

(71) Applicants: Matthias Werz, Engstingen (DE); Patrick Zimmermann, Constance (DE)

(72) Inventors: Matthias Werz, Engstingen (DE); Patrick Zimmermann, Constance (DE)

(73) Assignee: Matthias Werz, Engstingen (DE)

( * ) Notice: Subject to any disclaimer, the term of this patent is extended or adjusted under 35 U.S.C. 154(b) by 47 days.

(21) Appl. No.: 15/628,869

(22) Filed: Jun. 21, 2017

(65) Prior Publication Data

US 2017/0368385 A1 Dec. 28, 2017

(30) Foreign Application Priority Data

Jun. 28, 2016 (DE) ..... 10 2016 111 848

(51) Int. Cl.
*A62B 33/00* (2006.01)
*A63B 29/02* (2006.01)

(52) U.S. Cl.
CPC ..... *A62B 33/00* (2013.01); *A63B 29/021* (2013.01)

(58) Field of Classification Search
CPC . A63B 29/021; A63B 2029/022; A62B 33/00; B63C 2009/007; B63C 9/18; B63C 9/19; B63C 9/24
See application file for complete search history.

(56) References Cited

U.S. PATENT DOCUMENTS

| | | | | |
|---|---|---|---|---|
| 3,889,601 | A * | 6/1975 | Koehne | F41H 13/00 102/261 |
| 4,365,628 | A * | 12/1982 | Hodel | A62B 7/02 128/205.12 |
| 6,220,909 | B1 * | 4/2001 | Aschauer | A62B 33/00 441/136 |
| 6,260,570 | B1 | 7/2001 | Wass et al. | |
| 6,270,386 | B1 | 8/2001 | Visocekas | |
| 6,837,245 | B2 * | 1/2005 | Matheny | A62B 9/02 128/205.21 |
| 7,536,818 | B1 * | 5/2009 | Margiotta | F41A 19/13 42/69.01 |
| 8,494,480 | B2 | 7/2013 | Aschauer et al. | |
| 9,945,488 | B2 * | 4/2018 | Baglini, Jr. | B64D 25/14 |

FOREIGN PATENT DOCUMENTS

| | | |
|---|---|---|
| DE | 10 2014 111 655 | 2/2016 |
| EP | 2 162 193 | 3/2010 |
| EP | 2 926 869 | 10/2015 |
| WO | WO 98/33559 | 8/1998 |

* cited by examiner

*Primary Examiner* — Ajay Vasudeva
(74) *Attorney, Agent, or Firm* — Collard & Roe, P.C.

(57) ABSTRACT

A deployment unit for an avalanche rescue system with an actuating handle has a coupling piece and a coupling element that can be connected to a function unit of the avalanche rescue system. The coupling piece and the coupling element are displaceable in a coupling channel in a handle holder of the deployment unit and are held in coupling connection by the coupling channel. The coupling connection is releasable when the coupling piece, the coupling element or both exit(s) from the coupling channel.

13 Claims, 3 Drawing Sheets

Figures 1A, 1B, 1C:
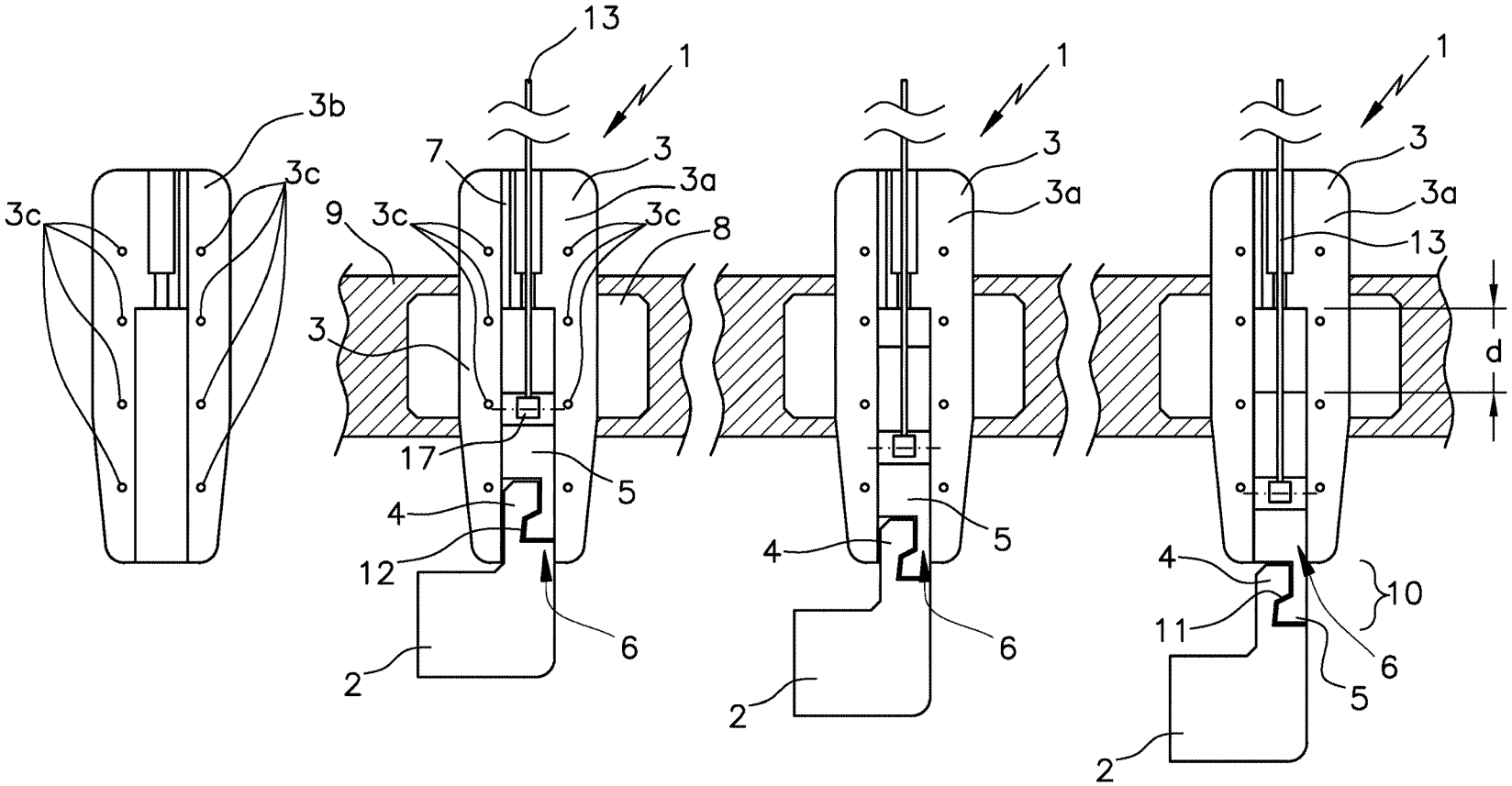

DEPLOYMENT UNIT FOR AN AVALANCHE RESCUE SYSTEM, USE OF AN ACTUATING HANDLE, AND DEPLOYMENT DEVICE

CROSS-REFERENCE TO A RELATED APPLICATION

The invention described and claimed hereinbelow is also described in German Patent Application DE 10 2016 111 848.6, filed on Jun. 28, 2016 (the German Patent Application). The subject matter of the German Patent Application are incorporated by reference herein. The German Patent Application provides the basis for a claim of priority of invention under 35 USC § 119(a)-(d).

BACKGROUND OF THE INVENTION

The invention is directed to a deployment unit for an avalanche rescue system having an actuating handle comprising a coupling piece.

Such a deployment unit is known from DE 10 2014 111 655 A1, for example.

Avalanche rescue systems for skiers and mountain climbers, for example, advantageously have a variety of function units, for example, an avalanche airbag and/or an avalanche balloon and/or a breathing function unit. However, it is necessary to be sure that in the event of danger, i.e., when an avalanche is approaching, the person to be protected must be able to trigger the various function units and/or component rescue systems of the avalanche rescue system. Therefore, a deployment unit having an actuating handle with which, by tearing off one portion of an actuating handle from another portion, a plurality of function units of the avalanche rescue system can be activated and/or triggered at the same time is known from the prior art described in the introduction. The tear-off portion of the actuating handle is itself part of the function unit. In particular this portion of the actuating handle has a mouthpiece. Therefore, function units can be triggered and the mouthpiece can be guided toward the person's mouth in a freely mobile manner at the same time.

However, it is a problem in the prior art that the function capacity of such a deployment unit must be ensured at all points in time and in all situations. In particular it is necessary to ensure that the handle is not released before the function unit is triggered.

OBJECTS AND SUMMARY OF THE INVENTION

The primary object of the invention is to ensure that the handle will not be released before deployment of the function unit, for example, an airbag.

The secondary object of the present invention is therefore to improve upon a deployment unit for an avalanche rescue system and in particular to offer an inexpensive solution that is easy to produce and can ensure deployment of function units of an avalanche rescue system even under the most adverse conditions.

This object is achieved by a deployment unit for an avalanche rescue system, having an actuating handle comprising a coupling piece and having a coupling element that can be connected to a function unit of the avalanche rescue system, wherein the coupling piece and the coupling element can be displaced in a coupling channel of a handle holder of the deployment unit and are held by the coupling channel in a coupling connection, and the coupling connection can be released when the coupling piece and/or the coupling element leave(s) the coupling channel.

The coupling element may be connected to a function unit of the avalanche rescue system. In particular it is possible to provide that the function unit is deployed by displacement of the coupling element. Thus, if the actuating handle is moved away and/or torn off from the handle holder, then the coupling piece entrains the coupling element with it along the coupling channel. The function unit can be deployed in this way. Then if the coupling piece and/or the coupling element leave(s) the coupling channel, the coupling connection can be released. In other words, the coupling channel forms a sleeve, which prevents deployment of the coupling connection between the coupling element and the coupling piece as long as the coupling piece and/or the coupling element is/are in the coupling channel. It is thus possible to ensure that the coupling element is moved along the coupling channel and therefore the function unit is deployed and only then can the actuating handle be moved freely.

It is especially advantageous if the coupling connection is a form-fitting and/or force-locking connection. Coupling connections can therefore be established in a particularly simple manner. In particular the coupling piece and coupling element may engage in one another. Form-fitting and/or force-locking coupling connections also enable the deployment unit to be designed to be reusable several times because after the coupling connection has been released, the connection can be reestablished easily. The avalanche rescue system may thus also be used again after its use without requiring expensive replacement parts.

A force-locking connection can be achieved by means of an electrical and/or magnetic connection, for example. To establish a form-fitting connection, the coupling piece and the coupling element may have complementary shapes in at least some areas.

It is possible to provide that the coupling element and/or the coupling piece can be arranged in a rotationally fixed manner in the coupling channel. For example, the coupling channel may have a noncircular cross section. In particular the coupling element and/or the coupling piece may have a rotationally symmetrical oval cross section in at least some sections. The coupling element and/or the coupling piece may also be formed with a trapezoidal, preferably rectangular cross section. The cross section of the coupling channel is designed to be complementary to the coupling element and/or to the coupling piece in at least some sections. If the coupling element and/or the coupling piece has a cross section that corresponds to and/or is complementary to that of the coupling channel, then the coupling element and/or the coupling piece may be arranged in a rotationally fixed manner in the coupling channel. Thus, for example, it is possible to ensure that the actuating handle is always in an optimal position, i.e., location, on the handle holder. In particular it is possible to provide that the actuating handle is arranged in a position on the handle holder which makes it possible for a person to reliably grip the actuating handle.

It is possible to provide that the handle holder is assembled from at least two handle holder elements, wherein the coupling channel is formed by at least two of the handle holder elements. Thus the handle holder can be manufactured especially easily and the coupling channel can be designed easily. For example, the handle holder may be formed from two half-cylinders, which, when joined together, form the coupling channel in their internal region.

In a particularly preferred embodiment of the invention, it may additionally be provided that the coupling element and/or the coupling piece is/are displaceable in the coupling channel by at least a predefinable deployment distance d. For example, it is possible to provide that the function unit is connected to the coupling element and/or to the coupling piece in such a way that when the coupling element and/or the coupling piece is/are displaced by a predefinable deployment distance d, the function unit is deployed. Therefore, if the coupling channel has a length that makes it possible for the coupling element and/or the coupling piece to be displaceable by at least the predefinable deployment distance d within the coupling channel, then it is possible to ensure in a simple way that the function unit is reliably deployed before the coupling element can be released from the coupling piece.

In addition, it is possible to provide that the handle holder has an assembly aid borehole or opening into the coupling channel. After insertion of the deployment unit, the coupling piece can be released from the coupling element. For renewed use, the two parts must first be joined together again. To do so, an assembly aid pin can be inserted into the coupling channel through the assembly aid borehole and/or opening. Then the coupling element, for example, may be displaced out of the coupling channel until it can be connected to the coupling piece again.

It is also advantageous if the handle holder has an attachment section for fastening the handle holder on a carrier system of the avalanche rescue system. The carrier system may be, for example, a backpack or a carrier element inserted into a backpack or may be arranged on the various elements, in particular function units of the avalanche rescue system. The carrier system and/or the backpack may have, for example, a shoulder belt with a strap. The fixation section of the handle holder can be inserted into the strap, thereby securing the handle holder and/or the deployment unit, in particular in a predetermined position and/or in a predetermined location. Therefore the deployment unit can be mounted on and/or dismantled from the carrier system. The position and/or location can also be selected in such a way that the person can easily reach the actuating handle in the event of an emergency.

The releasability of the coupling element from the coupling piece can be facilitated by providing a bevel on the coupling element and/or the coupling piece in a coupling connection area.

It is also especially advantageous if the coupling element and/or the coupling piece has/have a catch section to establish the coupling connection. In this case, in particular after use of the deployment unit, the connection between the coupling element and the coupling piece can be reestablished by inserting the coupling piece into the coupling channel until it engages on the coupling element. To do so, the catch section may be formed from an elastic material.

It is especially advantageous if the coupling element and/or the coupling piece is/are connected to a cable pull. For example, the coupling element may then be connected to the function unit by a cable pull. In this way the function unit can be arranged at a distance from the deployment unit and nevertheless deployed with the aid of the deployment unit. It is especially advantageous that a cable pull can be arranged in a space-saving manner while having a low weight and almost any desired length.

Furthermore, it is possible to provide that the coupling element and/or the coupling piece is/are designed as a cable pull nipple. In particular it is possible to provide that both the coupling element and the coupling piece are designed as a cable pull nipple. Each cable pull nipple may be connected to a cable pull. With suitable dimensions of the coupling channel in relation to the coupling element and/or in relation to the coupling piece, it is then possible to establish a coupling connection in a particularly simple manner. To do so, one need only push the cable pull nipple, which corresponds to the coupling element, out of the coupling channel, while the cable pull nipple corresponding to the coupling piece is arranged downstream from the cable pull nipple corresponding to the coupling element, and the arrangement of the coupling element and the coupling piece must be reintroduced back into the coupling channel. A coupling connection formed in this way can be released by pulling on the cable pull of the cable pull nipple corresponding to the coupling piece until the arrangement again exits from the coupling channel because the cable pull nipples are rigidly and/or fixedly connected to one another in such an arrangement.

It is especially advantageous if the cable pull nipple has recesses so that the cable pull connected to the cable pull nipple can reach through the other cable pull nipples.

The actuating handle may be equipped with additional functions and/or function elements. In particular it is possible to provide that the actuating handle has a mouthpiece. Then the breathing of a person, for example, a person in an avalanche, can be facilitated by the mouthpiece, so that the actuating handle can be connected to a breathing function unit by means of a tube, for example. After the actuating handle is released from the deployment device, the actuating handle may be placed in a person's mouth.

Within the scope of the present invention, use of an actuating handle with a coupling piece in a deployment unit according to the invention is also noticed, wherein the coupling piece and a coupling element of the deployment unit are displaceable in a coupling channel of a handle holder of the deployment unit and are held by the coupling channel in a coupling connection, and the coupling connection is releasable when the coupling piece and/or the coupling element leave the coupling channel again.

It is possible in particular to provide that different actuating handles according to the invention are to be used and/or to be provided. Thus, for example, different actuating handles may be adapted individually to the needs of the person using the actuating handle. For example, the actuating handles may have variously shaped mouthpieces. If the actuating handles have suitable coupling pieces, then various actuating handles may be used with one and the same deployment unit.

In addition, the scope of the invention also includes a deployment device with a deployment unit according to the invention, wherein the deployment device has a resetting element for resetting the coupling element of the deployment unit. The resetting element may comprise, for example, a spring element, in particular a torsion spring element and/or may be designed as such. The resetting element may be connected to the coupling element, preferably by a cable pull. It is thus possible that, after deployment, the coupling element is automatically retracted back into the coupling channel. Furthermore, a tensile force threshold to be overcome for deployment can also be set by means of the resetting element. In particular the spring hardness of a resetting element designed as a spring element may therefore be adjusted and/or selected for this purpose. Therefore, inadvertent faulty deployment can be effectively prevented. Furthermore, it is possible to provide that the preselectable deployment distance d corresponds to the spring path of a resetting element, which is designed as a spring element or it is selected as a function thereof.

In an alternative embodiment, the resetting element may also be connected to the coupling piece, preferably by means of a cable pull, in particular to induce a reset of the coupling piece after deployment.

The handle holder and/or the coupling element and/or the actuating handle may advantageously be formed in at least some areas as an injection molded part or by 3D printing as a 3D printed part. Likewise it is possible to provide that the handle holder and/or the coupling element and/or the actuating handle is/are to be made of a corrosion-resistant material, for example, aluminum and/or plastic, preferably ABS plastic.

In addition, in a particularly advantageous manner it is possible to provide that the deployment unit can be connected to more than one function unit by means of the coupling element. For example, the coupling element may be connectable to two or three function units. For example, the function units may be designed as an avalanche airbag, an avalanche balloon or an avalanche beeper/pager and/or as a breathing function unit.

Additional features and advantages of the invention are derived from the following detailed description of exemplary embodiments of the invention, on the basis of the figures in the drawings, which show details that are essential to the invention, as well as from the claims. The features shown there need not necessarily be understood to be drawn to scale and represented in such a way that the particulars according to the invention can be made clearly visible. The various features may be implemented individually, alone or several together in any combination in variants of the invention.

The schematic drawing shows exemplary embodiments of the invention as well as views of individual components of the deployment unit according to the invention as well as the deployment device according to the invention, which are explained in greater detail in the following description.

BRIEF DESCRIPTION OF THE DRAWING FIGURES

Figure 2:
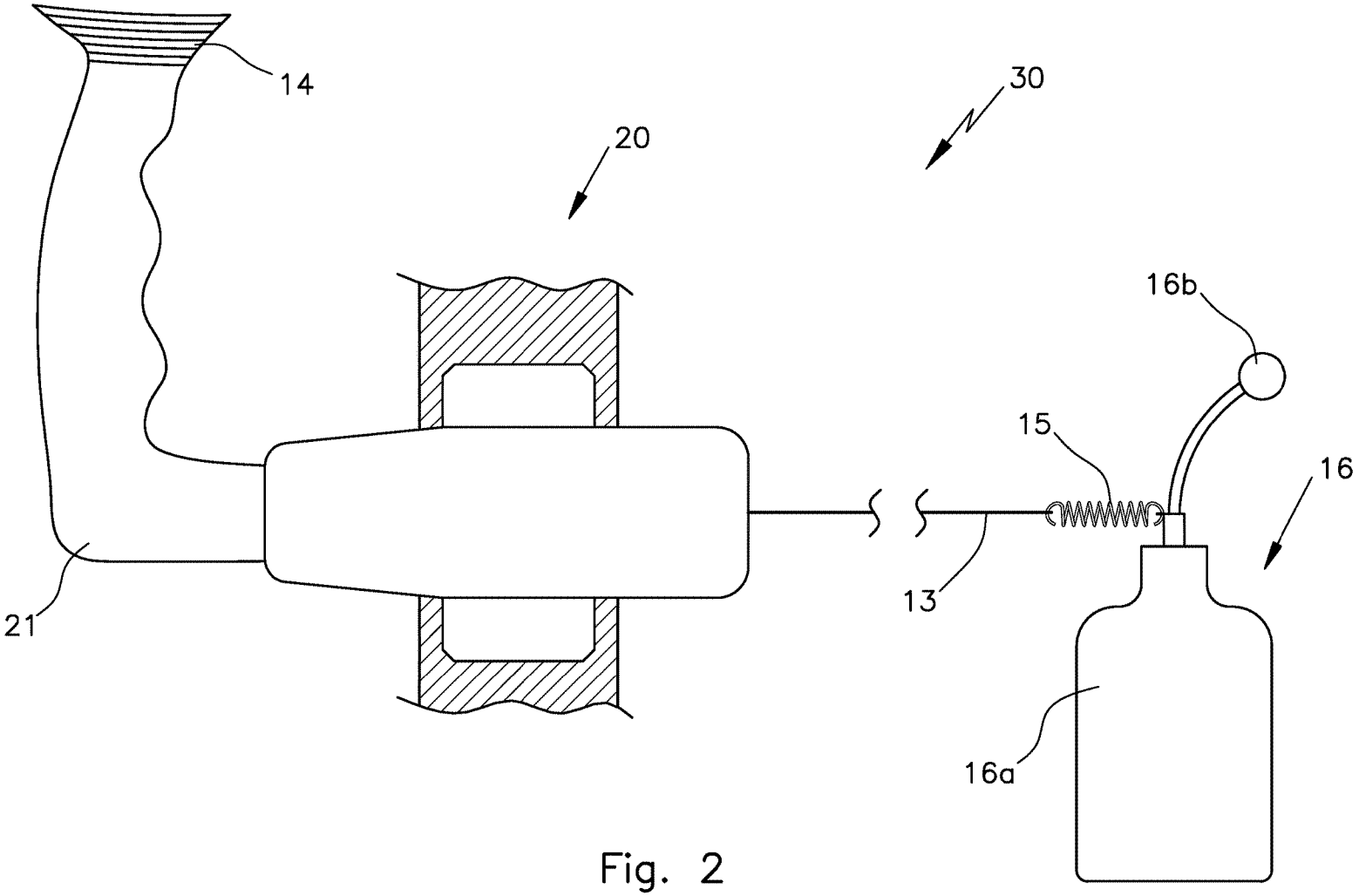
Figure 3:
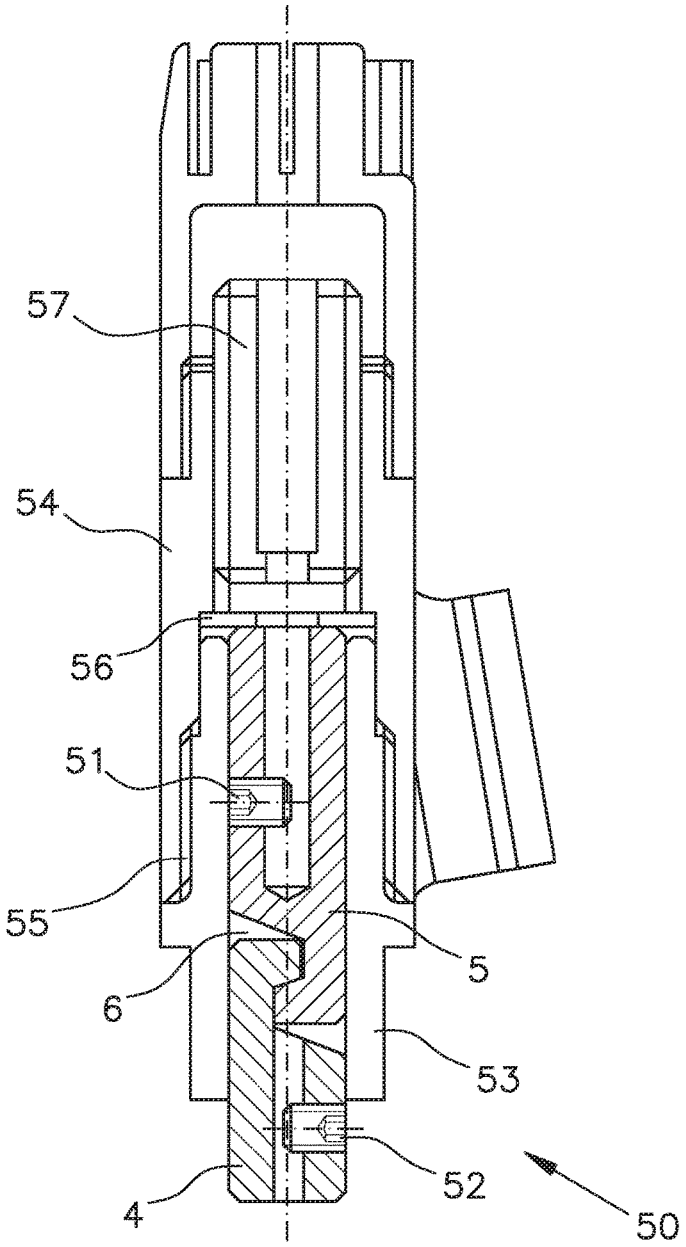

FIG. 1*a* depicts an exemplary embodiment of a deployment unit according to the invention in one of a number of different positions of the coupling element and/or coupling piece;

FIG. 1*b* depicts another position of the coupling element and/or coupling piece of the FIG. 1 embodiment;

FIG. 1*c* depicts another position of the coupling element and/or coupling piece of the FIG. 1 embodiment; and FIG. 2 shows a deployment device in an alternative embodiment of the deployment unit.

DETAILED DESCRIPTION OF THE INVENTION

FIG. 1*a* shows a deployment unit 1 for an avalanche rescue system. FIG. 1*a* shows two handle holder elements 3*a*, 3*b* with complementary shapes. These can be connected to one another by means of handle holder connections 3*c* arranged on them, namely plug connections in this embodiment, which are plugged together in this embodiment. In the connected state, they form a handle holder 3 of the deployment unit 1.

The internal structure of the handle holder 3 as well as components of the deployment unit 1 contained in the handle holder 3 are described in greater detail below. To this end, the handle holder 3 is shown as open in FIG. 1*a*, i.e., handle holder elements 3*a*, 3*b* that are not attached to one another are shown.

This shows first a schematically illustrated actuating handle 2 of the deployment unit 1. A coupling piece 4, which engages with a coupling element 5 in a form-fitting manner, is arranged on the actuating handle 2. The coupling piece 4 and the coupling element 5 are arranged in a coupling channel 6 formed by opposing recesses in the two handle holder elements 3*a*, 3*b*. The coupling channel 6 is designed to have a rectangular cross section, so that the coupling element 5 and the coupling piece 4 are arranged in a rotationally fixed position in the coupling channel 6.

The handle holder 3 is secured by means of a fixation section 8 on a carrier system 9, in particular on a shoulder belt of a backpack, which serves as a carrier system 9, by using a strap.

FIG. 1*a* additionally shows that the coupling element 5 is connected to a cable pull nipple 17 of a cable pull 13. The cable pull 13 therefore leads through a section of the coupling element 5 and is secured by the cable pull nipple 17 in that the cable pull nipple 17 is supported on the coupling element 5. The coupling piece 4 and the coupling element 5 are arranged displaceably in the coupling channel 6. The cable pull nipple 17 and the cable pull 13 are therefore entrained by the coupling element 5 when the latter is displaced in the coupling channel 6.

The cable pull 13 may be connected to a function unit of the avalanche rescue system. Due to the downward displacement of the coupling element 55 coupled to the cable pull 13—in the diagram shown in FIG. 1*a*—the function unit can be triggered and/or activated.

FIG. 1*a* also shows that the handle holder 3 and/or the handle holder elements 3*a*, 3*b* have an assembly aid borehole 7, which opens into the coupling channel 6. An assembly aid pin through which the coupling element 5 can be shifted out of the coupling channel 6, for example, to establish a coupling connection between the coupling piece 4 and the coupling element 5, can be inserted through the assembly aid borehole 7. In this exemplary embodiment, the coupling element 5 additionally has a catch section 12. The catch section 12 is designed so that the coupling piece 4 can be pushed onto the coupling element 5 and then engages with it in a coupling connection. There are therefore various possibilities for establishing a coupling connection between the coupling piece 4 and the coupling element 5.

In alternative embodiments of the invention, it is provided that either an assembly aid channel 7 or a catch section 12 is formed in a deployment unit.

FIG. 1*b* and FIG. 1*c* now show the same deployment unit 1, but the handle holder element 3*b* is not illustrated in either figure for reasons of simplicity.

In particular FIGS. 1*b* and 1*c* show two snapshots of the deployment unit 1 while with the help of the actuating handle 2 the coupling piece 4 and the coupling piece 5 are pulled out of the handle holder 3. FIG. 1*b* therefore shows a position in which the coupling piece 4 and the coupling element 5 are still in the coupling channel 6. However, FIG. 1*c* illustrates a position, in which the coupling piece 4 has already exited from the coupling channel 6.

It can be seen here that, in the position shown in FIG. 1*c*, the coupling channel 6 no longer holds the coupling connection between the coupling element 5 and the coupling piece 4, in contrast with the positions illustrated in FIGS. 1*a* and 1*b*. In the position in FIG. 1*c*, the coupling piece 4 can be released from the coupling element 5 easily, reliably and with the least possible application of force, in particular being released automatically by further pulling on the actuating handle 2. In order to further facilitate the release of the connection, the coupling piece 4 and the coupling element 5 each have a bevel 11 in a coupling connection area 10. The bevel 11 is oriented in such a way that when the coupling piece 4 is extracted and/or the coupling element 5 is pulled out of the coupling channel 6, the coupling piece 4 slides away from the coupling element 5 laterally and thus the coupling connection is released automatically.

After releasing the coupling connection, the actuating handle 2 is thus freely movable.

Furthermore, FIG. 1*c* in combination with FIG. 1*a* shows that the coupling element 5 is displaced by a preselectable deployment distance d. The length of the coupling channel 6 is therefore selected so that the coupling element 5 can be displaced at least by the deployment distance d within the coupling channel 6 without having to release the coupling connection between the coupling piece 4 and the coupling element 5. The coupling element 5 is therefore shifted at least by the deployment distance d before the coupling piece 4 and/or the actuating handle 2 is/are uncoupled and/or enter(s) the corresponding position shown in FIG. 1*c*. This ensures that the cable pull 13 can also be displaced at least by the deployment distance d.

FIG. 2 now shows a deployment device 30 with a deployment unit 20. The deployment unit 20 in this exemplary embodiment corresponds to the deployment unit 1. It differs only in the design of an alternative actuating handle 21. This actuating handle 21 has a mouthpiece 14 in particular. Therefore, after releasing the actuating handle 21, the mouthpiece 14 can be brought to the user's mouth and/or to the mouth of a person to be protected by the avalanche rescue system, and the person can be supplied with air, for example. To this end, the actuating handle 21 is connected to a respiratory function unit by means of a tube (not shown).

This additionally shows that a resetting element 15, which puts the cable pull 13 under a prestress, is attached to the cable pull 13. The resetting element 15 is therefore embodied as a spring element. The deployment distance d (FIG. 1*c*) and the minimum required force for deployment are predefined by the choice of the spring hardness and the spring distance of the resetting element 15.

In addition, it can be seen that a function unit 16 is connected to the cable pull 13. The function unit 16 in this exemplary embodiment is designed as an avalanche balloon 16*b*, which is connected to a pressurized gas cartridge 16*a*. The function unit 16 here is equipped, so that the pressurized gas cartridge 16*a* is opened and displacement of the cable pull 13 by the deployment distance d and the avalanche balloon 16*b* is inflated. In other words, the function unit 16 is deployed when the cable pull 13 is moved by the deployment distance d.

The present invention therefore makes it possible to pull the actuating handle 2 and/or the actuating handle 21 away from the deployment unit 1 and/or the deployment unit 20 and thus to reliably deploy the function unit 16.

Since the coupling connection in particular does not require any demanding mechanisms or the like, interference with the deployment unit, in particular failure of the function unit 16 to deploy can be effectively prevented even under the most adverse temperature conditions, etc.

LIST OF REFERENCE NUMERALS

1, 20 deployment unit
2, 21 actuating handle
3 handle holder
3*a*, 3*b* handle holder elements
3*c* handle holder connection
4 coupling piece
5 coupling element
6 coupling channel
7 assembly aid bore
8 fixation section
9 carrier system
10 coupling connection area
11 bevel
12 catch section
13 cable pull
14 mouthpiece
15 resetting element
16 function unit
16*a* pressurized gas cartridge
16*b* avalanche balloon
17 cable pull nipple
30 deployment device
d deployment distance

What is claimed is:

1. A deployment unit for an avalanche rescue system configured with function unit, the deployment unit comprising:

an actuating handle having a coupling piece connected thereto;

a coupling element that can be connected to the function unit of the avalanche rescue system; and a handle holder;

wherein the coupling piece and the coupling element are displaceable together along a common longitudinal axis in a coupling channel in the handle holder and are held in a coupling connection by the coupling channel; and wherein the coupling connection is releasable when the coupling piece, the coupling element or both exit from the coupling channel.

2. The deployment unit according to claim 1, wherein the coupling connection is form-fitting, force-locking or both.

3. The deployment unit according to claim 1, wherein the coupling element, the coupling piece or both are arranged in a rotationally fixed manner in the coupling channel.

4. The deployment unit according to claim 1, wherein the handle holder is assembled from at least two handle holder elements, and wherein the coupling channel is formed by at least two of the handle holder elements.

5. The deployment unit according to claim 1, wherein the coupling element, the coupling piece are displaceable by a predefinable deployment distance (d) in the coupling channel.

6. The deployment unit according to claim 1, wherein the handle holder has an assembly aid borehole or opening that opens into the coupling channel.

7. The deployment unit according to claim 1, wherein the handle holder has a fixation section for fastening the handle holder on a carrier system of the avalanche rescue system.

8. The deployment unit according to claim 1, wherein the coupling element, the coupling piece or both has/have a bevel in a coupling connecting area.

9. The deployment unit according to claim 1, wherein the coupling element, the coupling piece or both has/have a catch section for establishing the coupling connection.

10. The deployment unit according to claim 1, wherein the coupling element, the coupling piece or both are connected to a cable pull.

11. The deployment unit according to claim 1, wherein the actuating handle has a mouthpiece.

12. A deployment device having a deployment unit according to claim 1, a function unit and a resetting element, wherein the resetting element resets the coupling element.

13. A method of using a deployment unit for an avalanche rescue system configured with function unit, the deployment unit comprising an actuating handle with a coupling piece connected thereto, a coupling element that is connectable to the function unit of the avalanche rescue system and a handle holder, wherein the coupling piece and the coupling element are displaceable along a common longitudinal axis in a coupling channel in the handle holder and are held in a coupling connection by the coupling channel, wherein the coupling connection is releasable when the coupling piece, the coupling element or both exit from the coupling channel, the method comprising the steps of:

displacing the coupling piece and the coupling element together in the coupling channel of the handle holder, and releasing the coupling connection that couples the coupling piece and coupling element in the coupling channel when the coupling piece, the coupling element or both are removed from the coupling channel.

* * * * *